US008662971B2

(12) United States Patent
Warner

(10) Patent No.: US 8,662,971 B2
(45) Date of Patent: Mar. 4, 2014

(54) DOOR INSERT FOR BALANCING AIR PRESSURE

(75) Inventor: Nelson Albert Warner, Northbridge, MA (US)

(73) Assignee: Tamarack Technologies, Inc., Buzzards Bay, MA (US)

( * ) Notice: Subject to any disclaimer, the term of this patent is extended or adjusted under 35 U.S.C. 154(b) by 252 days.

(21) Appl. No.: 13/016,051

(22) Filed: Jan. 28, 2011

(65) Prior Publication Data

US 2012/0003914 A1 Jan. 5, 2012

Related U.S. Application Data

(60) Provisional application No. 61/360,537, filed on Jul. 1, 2010.

(51) Int. Cl.
*E06B 7/02* (2006.01)

(52) U.S. Cl.
USPC ..... 454/195; 454/238; 454/243

(58) Field of Classification Search
USPC ..... 454/195, 238, 243
See application file for complete search history.

(56) References Cited

U.S. PATENT DOCUMENTS

| | | | | | |
|---|---|---|---|---|---|
| 355,904 | A | * | 1/1887 | Abrahamson | 454/195 |
| 1,116,625 | A | * | 11/1914 | Pomerantz | 454/211 |
| 1,265,978 | A | | 5/1918 | Wade et al. | |
| 1,324,973 | A | * | 12/1919 | McQueen | 49/64 |
| 1,335,948 | A | * | 4/1920 | Wellman | 454/195 |
| 1,701,993 | A | * | 2/1929 | Wills | 454/195 |
| 1,705,321 | A | * | 3/1929 | Weaver | 49/98 |
| 1,896,053 | A | | 1/1933 | Fisk | |
| 2,105,735 | A | * | 1/1938 | Hodge | 49/193 |
| 2,129,397 | A | * | 9/1938 | Bailey | 49/38 |
| 2,175,348 | A | * | 10/1939 | Hagstrom | 292/78 |
| 2,194,137 | A | | 3/1940 | Copersito | |
| 2,203,753 | A | * | 6/1940 | Strandt | 160/44 |
| 2,239,255 | A | | 4/1941 | Shaw | |

(Continued)

FOREIGN PATENT DOCUMENTS

| | | |
|---|---|---|
| FR | 1222797 A | 6/1960 |
| JP | 6146733 A | 5/1994 |

OTHER PUBLICATIONS

"Building a ventilated cabinet door", This old house—http://www.thisoldhouse.com/toh/skill-builder/020058826,00.html Nov. 2007.*

(Continued)

*Primary Examiner* — Steven B McAllister
*Assistant Examiner* — Jonathan Cotov
(74) *Attorney, Agent, or Firm* — Barlow, Josephs & Holmes, Ltd.

(57) ABSTRACT

The door insert of the present invention balances air pressure in a closed environment. It includes a frame that defines a slot. A pair of tabs emanates from opposing sides of the frame to attach the frame to a door. Media, which has a plurality of apertures therethrough, resides in the slot. The frame, with media installed therein resides within a notch in an edge of a door. Air is permitted to flow through the door insert to balance the air pressure within an environment divided by the door. The frame is preferably ABS plastic and the media is preferably paper. The appearance of the frame and media may be modified to aesthetically match the decor of the door, door hardware and surrounding environment.

10 Claims, 8 Drawing Sheets

(56) References Cited

U.S. PATENT DOCUMENTS

| | | | | | |
|---|---|---|---|---|---|
| 2,568,592 | A | * | 9/1951 | O'Connor | 292/87 |
| 2,575,499 | A | * | 11/1951 | Manow | 55/422 |
| 2,704,504 | A | | 3/1955 | Wilkening | |
| 2,771,021 | A | * | 11/1956 | Buckley | 454/195 |
| 2,798,422 | A | * | 7/1957 | Bourque | 454/195 |
| 3,094,058 | A | * | 6/1963 | O'Brien, Jr. et al. | 454/195 |
| 3,402,579 | A | * | 9/1968 | Hallgren | 70/489 |
| 3,616,743 | A | * | 11/1971 | Alter | 454/213 |
| 3,861,081 | A | * | 1/1975 | Maskell | 49/70 |
| 4,048,756 | A | * | 9/1977 | Lawrence | 49/171 |
| 4,163,144 | A | * | 7/1979 | Reynier | 392/372 |
| 4,274,330 | A | * | 6/1981 | Witten et al. | 454/276 |
| 4,669,371 | A | * | 6/1987 | Sarazen et al. | 454/276 |
| 4,770,087 | A | * | 9/1988 | Danley et al. | 454/195 |
| 4,957,038 | A | * | 9/1990 | Hamilton | 454/195 |
| 5,176,570 | A | * | 1/1993 | Liedl | 454/309 |
| D338,713 | S | * | 8/1993 | Cox et al. | D23/328 |
| 5,376,044 | A | * | 12/1994 | Tippin et al. | 454/211 |
| 5,863,310 | A | * | 1/1999 | Brown et al. | 55/480 |
| 5,944,860 | A | * | 8/1999 | Mack et al. | 55/492 |
| 6,074,296 | A | * | 6/2000 | Wu | 454/184 |
| 6,234,893 | B1 | * | 5/2001 | Meredith | 454/289 |
| 6,383,241 | B1 | * | 5/2002 | Janus et al. | 55/385.2 |
| 6,386,969 | B1 | * | 5/2002 | O'Brien | 454/195 |
| 6,406,076 | B1 | * | 6/2002 | Zarzycki, Jr. | 292/346 |
| 6,431,980 | B1 | * | 8/2002 | Achen | 454/271 |
| 6,454,646 | B1 | | 9/2002 | Helgenberg et al. | |
| 6,485,213 | B1 | * | 11/2002 | Viale | 403/12 |
| 6,485,231 | B2 | * | 11/2002 | Montgomery et al. | 405/92 |
| 6,558,247 | B1 | * | 5/2003 | Peak | 454/213 |
| 6,574,932 | B2 | * | 6/2003 | Layne et al. | 52/302.4 |
| 6,604,994 | B2 | * | 8/2003 | Achen | 454/271 |
| 6,623,540 | B2 | * | 9/2003 | Clayton et al. | 55/480 |
| 6,648,750 | B1 | * | 11/2003 | Wiseman | 454/195 |
| 6,715,527 | B2 | * | 4/2004 | Ardoin | 160/104 |
| 6,758,744 | B1 | | 7/2004 | Dai | |
| 6,814,660 | B1 | * | 11/2004 | Cavett | 454/284 |
| 6,875,102 | B2 | * | 4/2005 | Achen | 454/283 |
| 7,117,823 | B2 | * | 10/2006 | Kirch et al. | 119/769 |
| 7,270,498 | B1 | * | 9/2007 | Albanese et al. | 405/104 |
| 7,575,617 | B2 | * | 8/2009 | Ferguson | 55/480 |
| 7,685,792 | B2 | * | 3/2010 | Stahl et al. | 52/656.3 |
| D613,393 | S | * | 4/2010 | Dorsey et al. | D23/397 |
| 7,951,291 | B2 | * | 5/2011 | Nino | 210/131 |
| 8,246,703 | B2 | * | 8/2012 | Bordin | 55/385.2 |
| 8,308,396 | B2 | * | 11/2012 | Shook | 405/100 |
| 2002/0124495 | A1 | * | 9/2002 | Layne et al. | 52/220.1 |
| 2003/0136351 | A1 | * | 7/2003 | Morgan | 119/484 |
| 2004/0014421 | A1 | * | 1/2004 | Raymer | 454/271 |
| 2005/0134061 | A1 | * | 6/2005 | Milo | 292/340 |
| 2005/0217803 | A1 | * | 10/2005 | Mitchell | 160/113 |
| 2006/0289127 | A1 | * | 12/2006 | Fowler | 160/180 |
| 2007/0023592 | A1 | * | 2/2007 | Makoso | 248/200.1 |
| 2007/0051317 | A1 | * | 3/2007 | Bruner | 119/53 |
| 2008/0016648 | A1 | * | 1/2008 | Lautenschlager | 16/238 |
| 2009/0208289 | A1 | * | 8/2009 | Flury | 405/94 |

OTHER PUBLICATIONS

"Forced-Air Systems Need pressure relief" Oikos—http://www.oikos.com/esb/44/forcedair.html Apr. 1998.*

"Standard Honeycomb Ventilation Panels" Honeycomb Ventiatlion—http://www.honeycomb-ventilation.com/ May 2008.*

"Building a Ventilated Cabinet Door", This Old House—http://www.thisoldhouse.com/toh/skill-builder/0,,20058826,00.html, Nov. 2007.

"Forced-Air Systems Need pressure Relief" Oikos—http://www.oikos.com/esb/44/forcedair.html, Apr. 1998.

"Standard Honeycomb Ventilation Panels" Honeycomb Ventilatino—http://www.honeycomb-ventilation.com/, May 2008.

* cited by examiner

DOOR INSERT FOR BALANCING AIR PRESSURE

CROSS REFERENCE TO RELATED APPLICATION

This application is related to and claims priority from earlier filed provisional patent application Ser. No. 61/360,537, filed Jul. 1, 2010, the entire contents thereof is incorporated herein by reference.

BACKGROUND OF THE INVENTION

The invention relates generally to air flow control within a closed environment, such as a house or office building. More specifically, the invention relates to and apparatus and method for balancing the air pressure within such an environment.

It is well known in the construction, architectural and interior design industries that enclosed spaces within a building, either of the commercial and residential nature, are susceptible to poor air quality. This is primarily due to lack of good ventilation and air circulation within that space. For example, spaces that are not exposed to good air flow or are exposed to moisture or particulate matter, such as bathrooms, are particularly problematic. As a result, the air quality can become poor that can create unwanted odors, growth of mold, health hazards, and the like.

Today, the air inside most homes is more polluted and unhealthy than outside air at its worst. The way air exchange has been done in the past has been to open windows. However, in today's market it is very costly to leave a window open at times particularly when it's cold or hot outside as this will compete with the heating or air conditioning systems that are operating at the time. Therefore, simply opening a window for ventilation and air circulation is not a viable or desirable option.

A better solution is to improve the airflow within the space and to balance the air pressure in that environment.

Air pressure is one of fundamental living conditions for human beings. Comfortable air pressure is usually about 1 atmospheric pressure at sea level. Tremendous efforts have been devoted to control the interior climate within a building construction, such as temperature, humidity, freshness, and air pressure. However, compared to the control over other parameters, the achievements and applications of control over air pressure within building constructions have been quite limited.

Air pressure control, in comparison with other interior climate control mechanisms, is more difficult for the fact that pressure difference is the direct driving force for air to flow. If the internal air pressure is significantly different from external atmospheric pressure, any direct connection between the internal air and external atmosphere, no matter where it is in the building, may quickly lead air to flow from high pressure regions to low pressure regions and thus to reduce the pressure difference between the internal air and the external air and between rooms of a given building structure. The use of doors, which may be closed to seal off a room, makes it more difficult to balance the air pressure within a building. This situation is further complicated when a return vent is on an opposing side of a closed door where that closed door prevents the return of air to the return vent for intended air circulation. An environment with poorly balanced air pressure will cause the entire HVAC system to suffer from poor performance and poor efficiency because the air handler and other components will be required to work harder to move the air within the space.

There are two basic issues in interior air pressure control. The first is sealing the enclosed airway and the second is keeping the internal air refreshed. For the reason discussed above, without sealing the enclosed airway, air will leak through any kinds of interstices of the building, which makes it very difficult to maintain a significant pressure difference between the internal air and external environment. However, since air cannot freely flow in and out of a fully sealed construction, measures need to be taken to keep the internal air refreshed.

In the past years, air pressure controls have mainly been applied in special restricted areas such as labs exposed to contaminated environment, patient rooms in hospitals that require special prevention of bacteria and other contaminants, or a manufacturing environment where cleaner air is necessary. For these special interests on special restricted areas, air pressure control have typically relied on complicated mechanical control systems to modulate the flow rates constantly in response to pressure fluctuations, which would be quite expensive to implement and maintain on a large scale and for significantly large pressure differences. Residential application of those implementations in territories like high altitude regions, where air pressure control is essentially meaningful to many people, could be too much luxury to be a common practice.

There have been attempts in the prior art to balance the air pressure in rooms that have closed doors. These efforts include jump ducts, air return vents and transfer grills that are installed in ceilings and through walls. These solutions are expensive and cumbersome to install. Also, they are not particularly attractive once installed. Transfer grilles can be very difficult to install, particularly because they are located in the center or middle of a door and not at an edge thereof. Other solutions include under cutting the door, such as much as one foot. For obvious reasons, this solution is typically not acceptable.

With the present invention, the application and maintenance of interior air pressure control systems in building constructions will be much less expensive than the conventional building ventilation systems. This will make residential usage of air pressure control in need become economically practical. Therefore, there is a need for an economical and inexpensive apparatus to facilitate the balancing or equilibrium of air pressure within a building structure. There is a need for an alternative to complicated and expensive air flow systems.

SUMMARY OF THE INVENTION

The present invention preserves the advantages of prior art air transfer grilles and other air pressure balancing systems. In addition, it provides new advantages not found in currently available devices and systems and overcomes many disadvantages of such currently available devices and systems.

The invention is generally directed to the novel and unique door insert for balancing air pressure. More specifically, the door insert of the present invention includes balances air pressure in a closed environment. It includes a frame that defines a slot. A pair of tabs emanates from opposing sides of the frame to attach the frame to a door. Media, which has a plurality of apertures therethrough, resides in the slot. The frame, with media installed therein resides within a notch in an edge of a door. Air is permitted to flow through the door insert to balance the air pressure within an environment divided by the door. The frame is preferably ABS plastic and the media is preferably paper. The appearance of the frame and media may be modified to aesthetically match the décor of the door, door hardware and surrounding environment.

It is therefore an object of the present invention to provide a device that can be easily installed on a door to balance air pressure within an environment, such a house.

Another object of the present invention is to provide a door insert for balancing air pressure that is quick and easy to install.

An object of the present invention is to provide a door insert for balancing air pressure that is inexpensive.

A further object of the present invention is to provide a door insert for balancing air pressure that is attractive in appearance.

Yet another of the present invention is to provide a door insert for balancing air pressure that is more effective in balancing air pressure in an closed environment than prior art devices and systems.

Another object of the present invention is to provide builders, HVAC contractors, architects and others an alternative solution to balance the air pressure within a building, namely, one with rooms that has closed doors.

There is a need for a door insert that is easier to install and more attractive than prior art transfer grilles.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

The present invention preserves the advantages of prior art air pressure balancing systems and methods. In addition, it provides new advantages not found in currently available systems and methods and overcomes many disadvantages of such currently available systems and methods.

Figure 1:
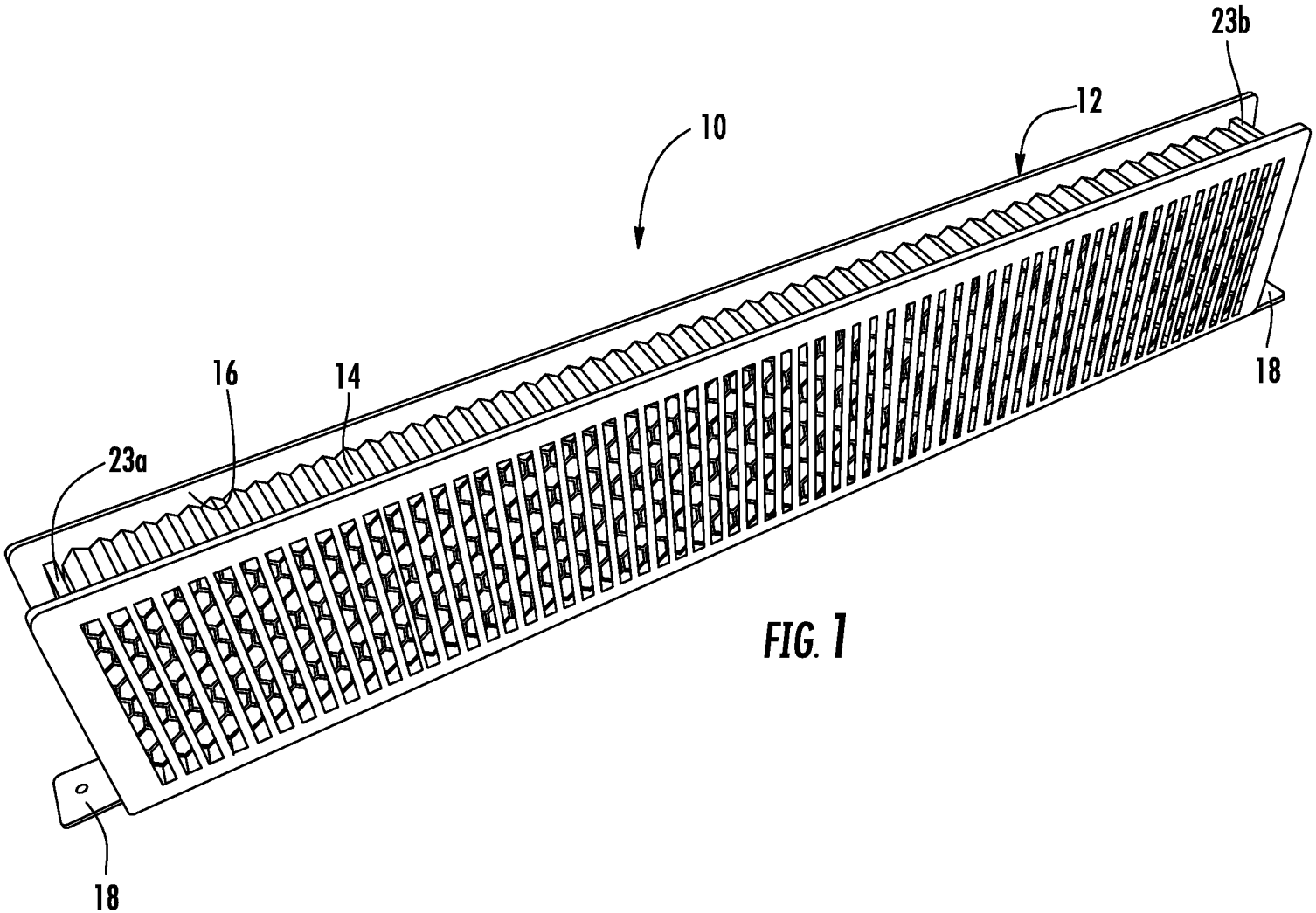
FIG. 1 is a perspective view of the door insert for balancing air pressure of the present invention.
Figure 2:
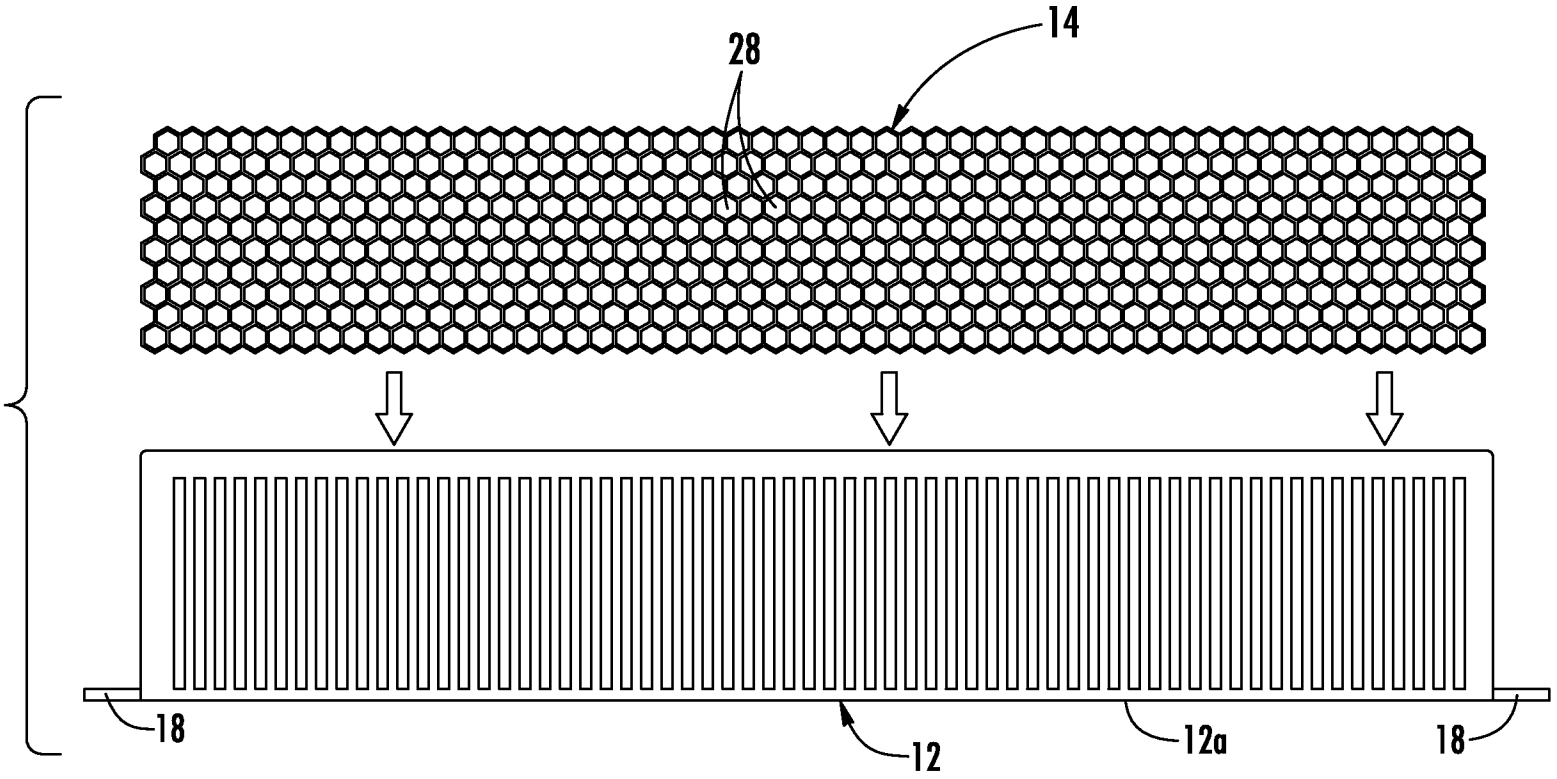
FIG. 2 is a front elevational view of the door insert of FIG. 1.

Referring first to FIGS. 1 and 2, the door insert 10 of the present invention includes, generally, an outer preferably substantially rigid frame 12 with media 14 installed therein. A vertical slot 16 is provided to downwardly receive the media 14 so that it may reside therein. A pair of tabs 18 are provided on opposing ends of the frame to secure the door insert 10 to a door, as will be described in detail below. Generally, a notch 32 is cut into an edge of a door, which receives the door insert 10 with the tabs 18 being fastened to the door on opposing sides thereof. Locating the door insert 10 of the present invention at an edge and within a notch 32 is much easier to install than a prior art transfer grill that is bounded on all sides by door material. Since the transfer grille is slid onto a door an into a notch 32, it is much easier to install than prior art transfer grilles.

Figure 3:
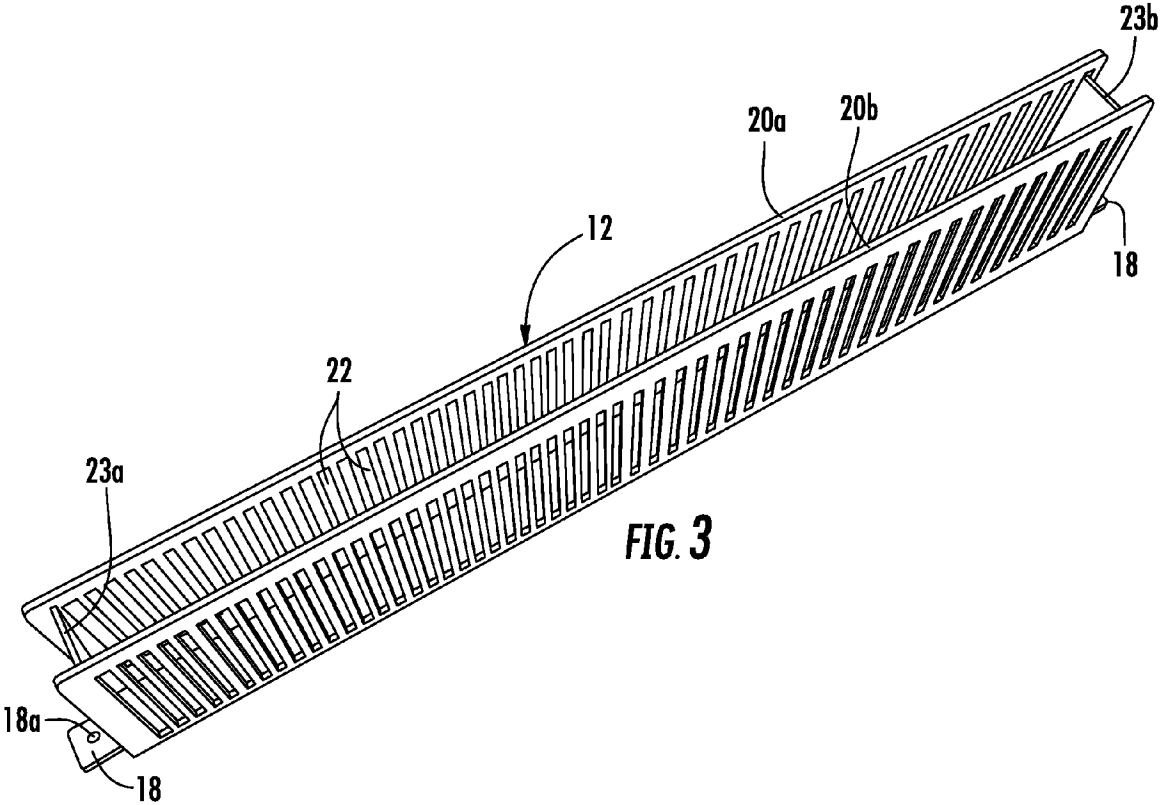
FIG. 3 is a perspective view of the frame of the door insert of FIG. 1.
Figure 4:
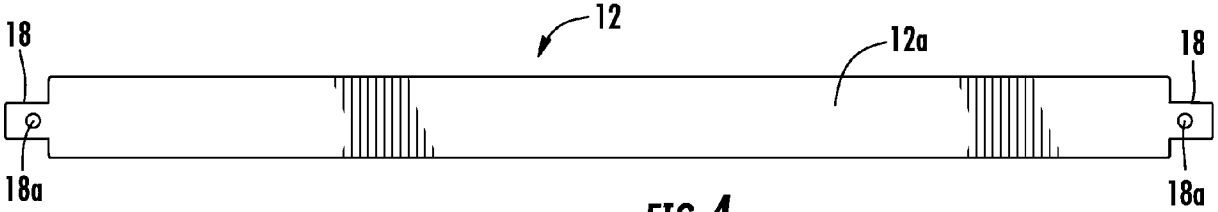
FIG. 4 is a bottom view of the frame of FIG. 3.
Figure 5:
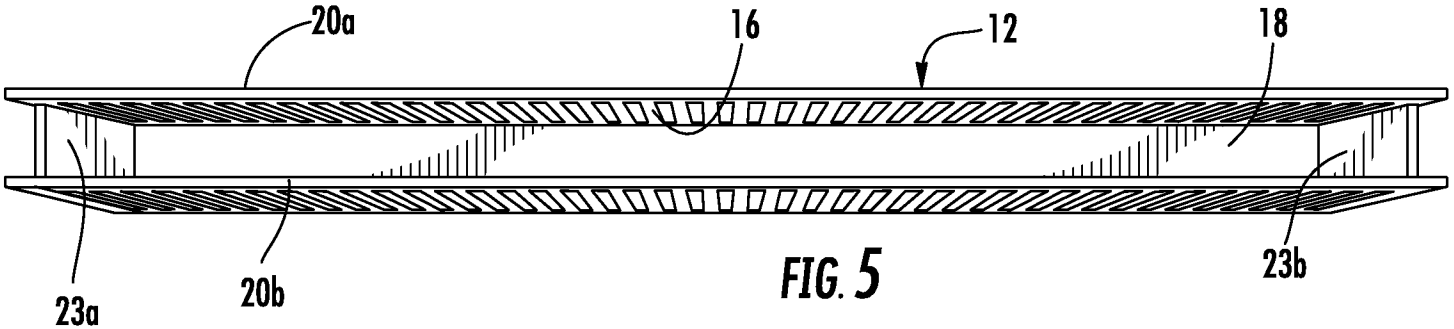
FIG. 5 is a top view of the frame of FIG. 3.

Turning now to FIGS. 3-5, details of the frame 12 used in the door insert 10 of the present invention are shown. The frame 12 includes a base plate with a front upstanding wall 20*b* and back upstanding wall 20*a*, which are preferably configured with a plurality of slots 22 therethrough. The slots 22 are preferably vertically positioned and the running the substantial entirety of the height of the side walls 20*a* and 20*b* but they could be horizontal or of any configuration, such as circles or other shapes. The side walls 23*a* and 23*b* are preferably solid in shape but also could be slotted. The length of the front wall 20*b* and back wall 20*a* can of be any length as they define how much air is permitted to pass through for air balancing control. For example, the height of the front and back walls 20*a* and 20*b* and side walls 23*a* and 23*b* can be in the range of 4-5 inches to provide a commensurate air passage for the most common required levels of air balancing in most environments. The door insert 10 may be larger or smaller depending on the environments size and air flow.

The frame 12 is preferably substantially rigid and made of an injection molded plastic but could be made out of any type of material, such as stamped or cast metal. It is preferably high impact ABS plastic. It can also be metallized for aesthetic appearance so the door insert 10 can match door hardware and the like.

Moreover, the frame 12 may be made out of one or more parts depending on the method of construction and the material used. For example, the frame is preferably made of two interlocking or mating parts, namely a left hand component and a right hand component. The left hand component may include the front wall 20*b*, a side wall 23*a* and half of the base plate 12*a* and one tab 18 while the right hand component may include the back wall 20*a*, the other side wall 23*b* and the other half of the base plate 12*a* with the other tab 18. The two parts may be glued or otherwise secured together. Such a two-part construction is preferred to facilitate the injection molding process to avoid complicated molds, collapsible cores and the costs associated therewith. However, any method for constructing the frame 12 may be employed.

Two tabs 18 respectively emanate from opposing ends of the base plate 12*a*. The tabs 18 include apertures 18*a* therethrough for receiving securing fasteners 24, which will be discussed below in connection with FIG. 15. As seen in FIG. 5, the media 14 resides between the front and back walls 20*a* and 20*b*. As can be seen in FIGS. 3 and 5, a rectangular slot or chamber 16 is defined by the frame 12 to receive the media 14 therein. The sizing of the media 14 relative to the rectangular slot or chamber 16 may be so the media is loose or provides a friction fit with the frame.

Figure 6:
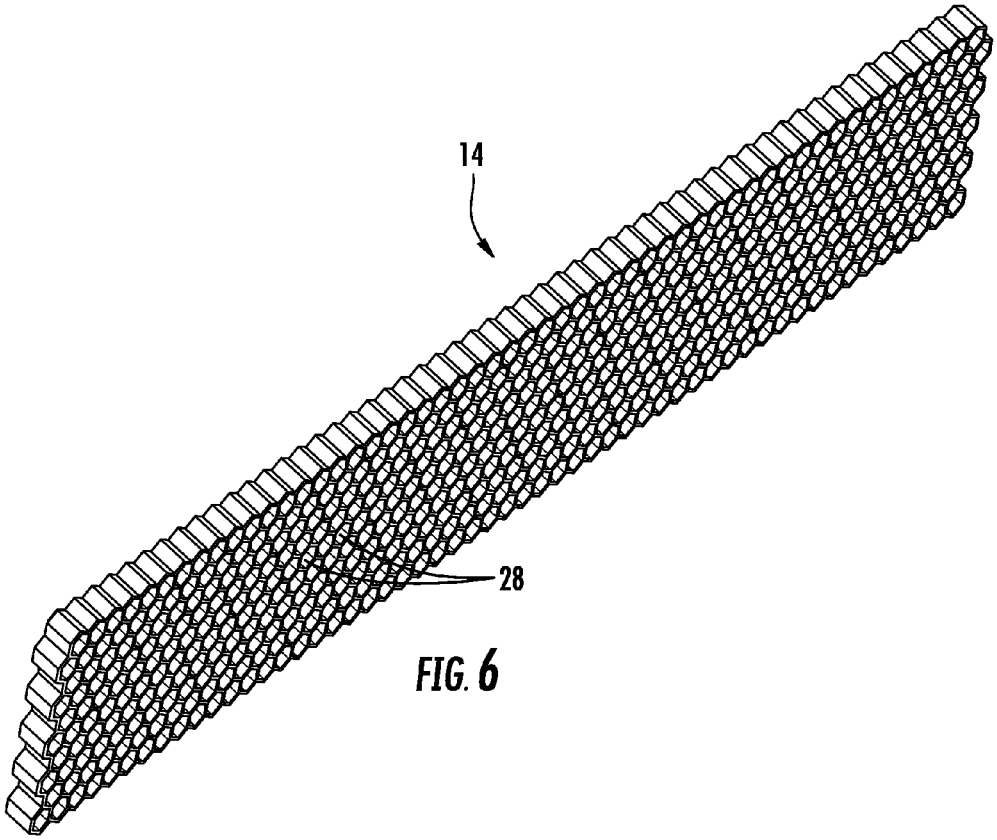
FIG. 6 is a perspective view of the media used in the door insert of FIG. 1.
Figure 7:
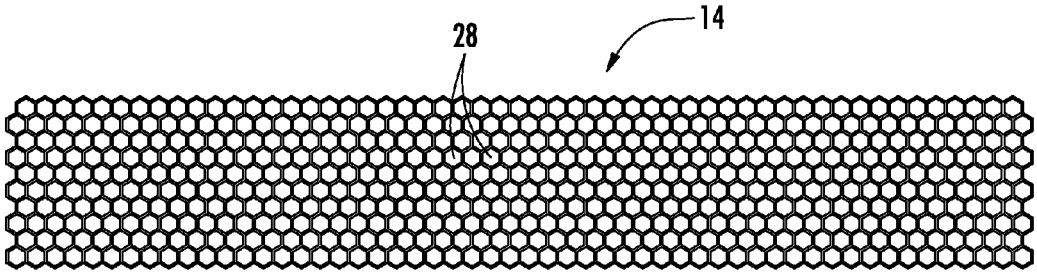
FIG. 7 is a front elevational view of the media of FIG. 6.

Turning now to FIGS. 6 and 7, further details of the media 14 used in the door insert 10 of the present invention is shown. The media 14 is preferably corrugated paper with a tunnel-like honeycomb structure with an array of apertures 28 therethrough. For example, a suitable paper media for the present invention is Hexacomb Resin Impregnated Paper, sold by the Pregis Corporation. The media employed includes pass-through holes to permit air to freely pass therethrough while reducing sound and light transmission. The media 14 can be provided in any desired color, such as white or black, for aesthetic matching to the environment.

Many different types of media can be used but the media shown in FIGS. 6-7 is just an example. For example, the media may be other materials, such as high impact ABS plastic, in similar fashion to the frame 12. If plastic is used for the media 14, it may be injection molded or otherwise formed. Also, the media 14 may be metal, metallized plastic or other materials.

The shape, depth, arrangement and configuration of the media 14 and its apertures 28 may be modified to suit the environment at hand. The parameters of the media 14 and its apertures 28 may be modified to give it and the overall door insert 10 different performance characteristics. It is intended that the media 14 is a permanent installation in that it need not be replaced unless it has been damaged. However, it can easily be replaced, if required, by detaching the frame from the door and sliding the media out for insertion of replacement media in its place.

Figure 8:
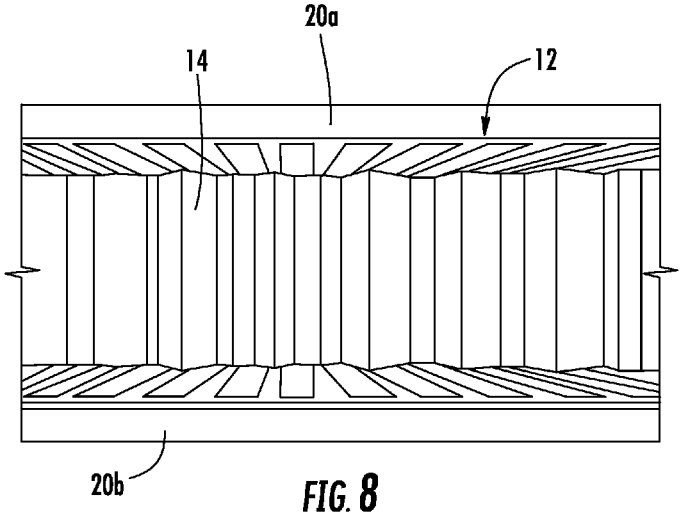
FIG. 8 is a close-up top view of the door insert of FIG. 1 showing the media residing in the frame.

The media 14 is cut or formed to the desired size so that it fits within the slot/chamber 16 defined by the frame 12, which can best be seen in FIG. 5. For example, as seen in FIG. 8, the width of the chamber 16 of the frame 12 can be about 1⅜ inches. Thus, the media 14 is preferably about 1⅛ inches for a slight friction fit, although a friction fit is not technically required. Preferably, the thickness of the media 14 is about the same thickness as a door onto which the door insert 10 is installed. The sizing of the media 14 are also scaled according to the thickness of a door 30, as seen in FIGS. 10-16, to receive the door insert 10 of the present invention.

Figure 9:
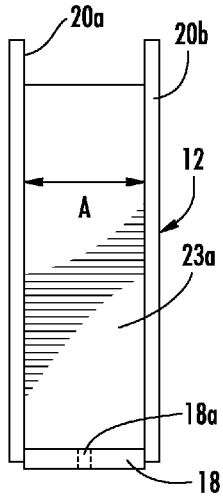
FIG. 9 is a side elevational view of the frame with media residing therein.

The distance A between the front wall 20*b* and the back wall 20*a*, as best seen in FIG. 9, are dimensioned to closely embrace the opposing front and back surfaces of a door 30, which is illustrated in FIGS. 10-16. In this example, the front and back walls 20*a*, 20*b* are disposed about 1⅜ inches apart to accommodate a door 30 that is of the same thickness. This dimensioning of the front wall 20*b* and the back wall 20*a* is desired to ensure an aesthetically pleasing appearance, as will be seen in connection with FIGS. 14-16 below.

Figure 10:
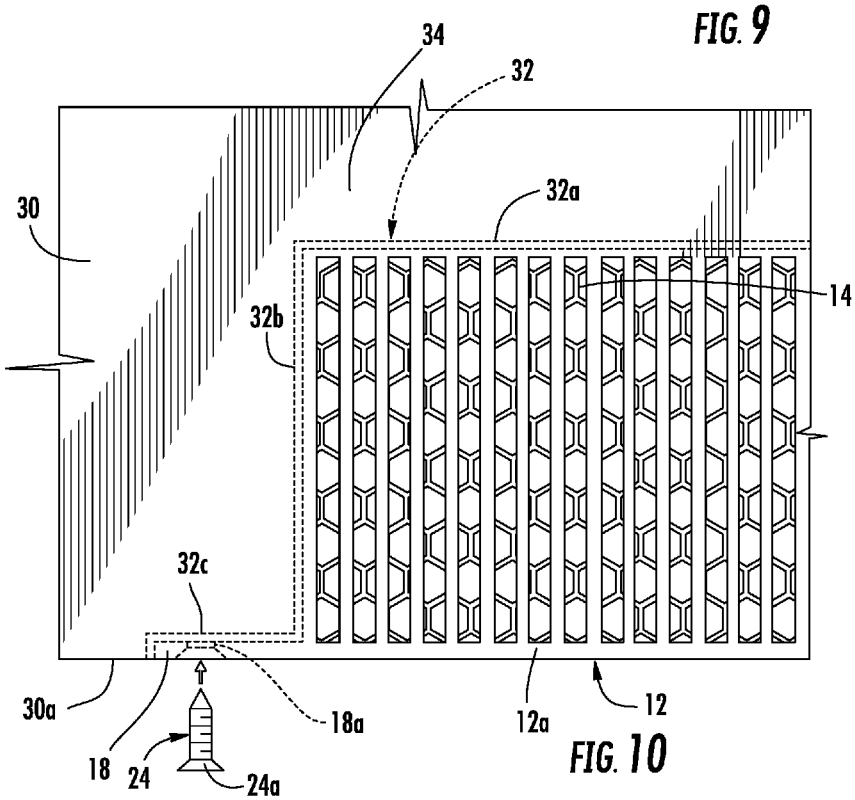
FIG. 10 is a front elevational view of the door insert of FIG. 1 installed into a cut out notch in the bottom edge of a door.

FIG. 10 illustrates a close-up view of the door insert 10 of the present invention installed into a notch 32 cut into an edge 30*a* of a door 30. The notch 32 includes segments 32*a*, 32*b* and 32*c*. Preferably, a shallow seat is provided by segment 32*c* into the bottom edge of the door to permit the tab 18 to sit recessed and thereby flush along the bottom edge 30*a* of the door 30. As can be seen in FIGS. 4 and 10, the fastener apertures 18*a* are preferably countersunk to permit the head 24*a* of fastener 24 to also be flush for an improved aesthetic appearance. For example, a drywall screw is be suitable for most door materials of wood and combinations thereof, two of which may be supplied with the door insert of the present invention when provided in kit form. It should be understood that the construction of the opposing side of the door insert 10 is identical in construction so it need not be discussed herein.

Still referring to FIG. 10, the outer peripheral marginal portions 34 of the front wall 20*b* and the back wall 20*a* overlaps at margin 34 in the range of 0.5 to 1 inch, in this example, to effectively hide the notch 32 cut into the door 30 thereby further enhancing the over aesthetics of the installed door insert 10. However, this overlap margin 34 may be larger or smaller. With this configuration, the media 14 resides within the chamber 16 of the frame 12 and being secured within the notch 32 with the assistance of the frame 12.

Figure 11:
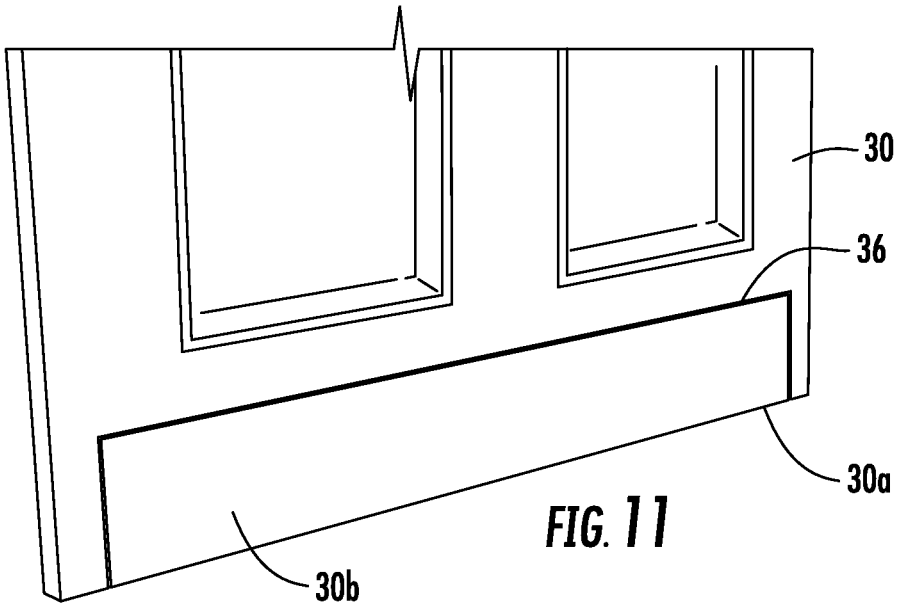
FIG. 11 is a perspective view showing a notch being cut out of the bottom edge of a door.

In FIGS. 11-16, the steps for installing and using the door insert 10 of the present invention is shown. In FIG. 11, a cut 36 is made in an edge of the door having a width generally defined by the distance between the outer edges of side walls 23*a* and 23*b* and a height generally defined by the distance from the bottom edge of the base 12*b* of the frame 12 to the top edges of the side walls 23*a*, 23*b*. In this case, which is preferred, a cut for the notch 32 is made into the bottom edge 30*a* of the door 30 for installation of the door insert 10 at that location. It is also possible to install the door insert 10 at the top edge of door (not shown), which may be more desirable in certain environments. For ease of illustration, installation of the door insert 10 into the bottom edge 32*a* of a door will be shown.

Figure 12:
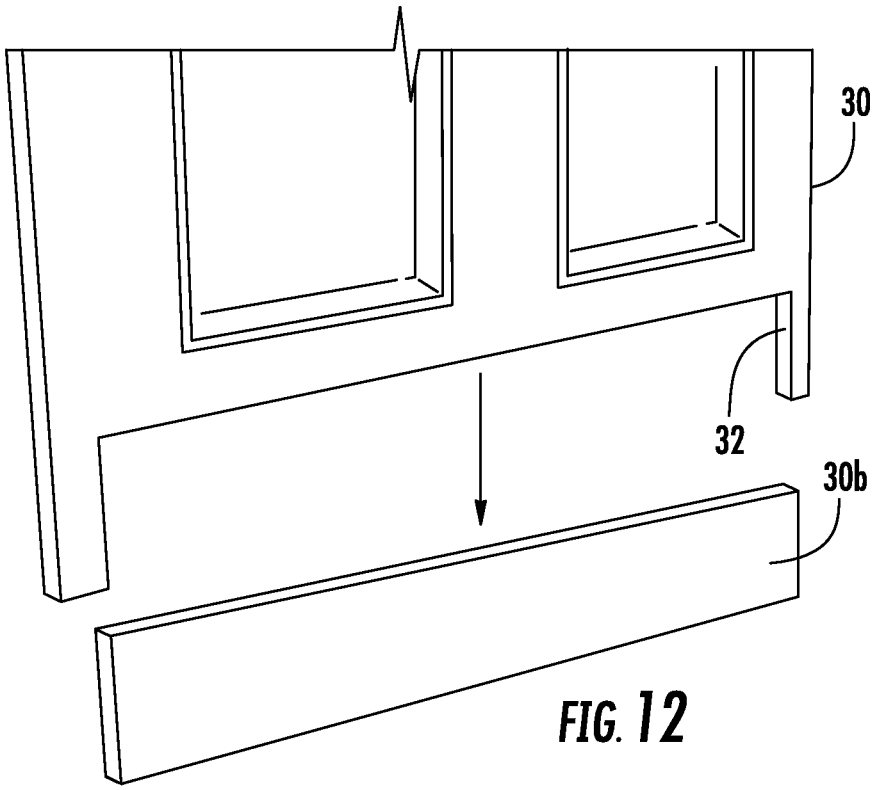
FIG. 12 is a perspective view of removal of a portion of the door to create a notch.

FIG. 12 illustrates removal of a portion 30*b* of the door 30 to reveal a notch 32 for receipt of the door insert 10 of the present invention. The excess portion 30*b* of the door may be discarded. It is possible that a door manufacturer may provide a door 30 for sale with this notch 32 already present therein obviating the need for the installer of the door insert 10 to cut out a notch 32 as shown in FIGS. 11 and 12. Also, it is possible that a contractor may install the door insert 10 in the field or a manufacturer may install the door insert 10 at the factory.

The notch 32 and corresponding door insert 10 are preferably of a general rectangular shape which balances appearance with ability to permit the needed air flow. However, any shape and configuration may be used. For example, the notch 32 and door insert 10 may be square or even trapezoidal although the latter would be more difficult to install. Therefore, perpendicular and straight line cuts for the notch 32 and for a standardized media configuration are preferred. As a result, a door insert 10 with a matching configuration is also preferred.

Figure 13:
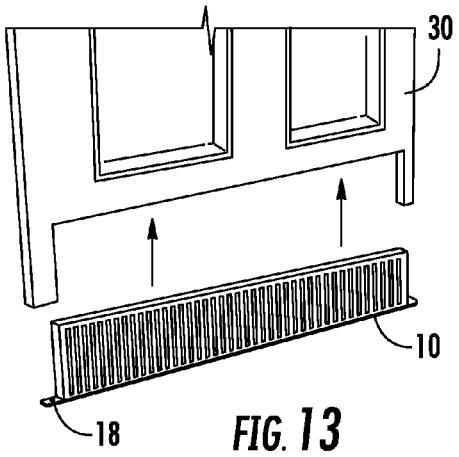
FIG. 13 is a perspective view showing installation of the door insert of the present invention of FIG. 1.
Figure 14:
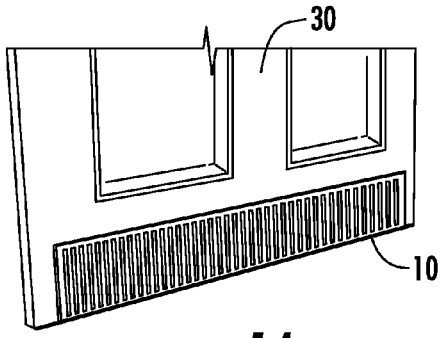
FIG. 14 is a perspective view of the door insert of FIG. 1 residing in the cut out notch in the door; a close-up of which is seen in FIG. 10.
Figure 15:
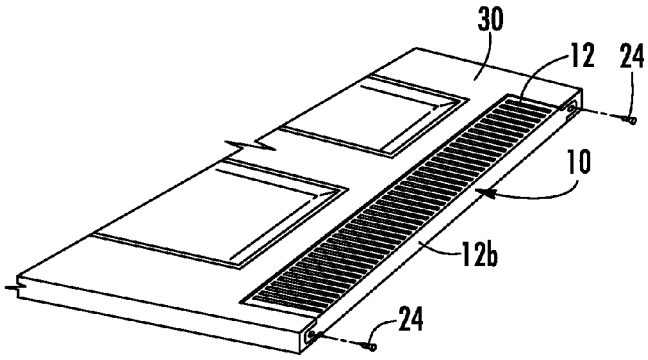
FIG. 15 is a bottom perspective view of the completion of the installation of the door insert by fastening the frame tabs to the bottom edge of the door.

Turning now to FIG. 13, the door insert 10 is aligned with the notch 32 and then, as in FIG. 14, is routed over the notch 32 in the door 30 so that it resides fully in the notch 32. A close-up of the interfacing of the door insert 10 into the notch is shown in FIG. 10, discussed above. In FIG. 15, the door insert 10 is secured to the bottom edge 30*a* of the door 30 by fasteners 24 that are routed through the apertures 18*a* in the tabs 18 that emanate from the base 12*a* of the frame 12. With the base plate 12*a* secured to the bottom edge 30*a* of the door 30, the entire frame 12 is locked to the periphery of the notch 32 to complete the installation.

Figure 16:
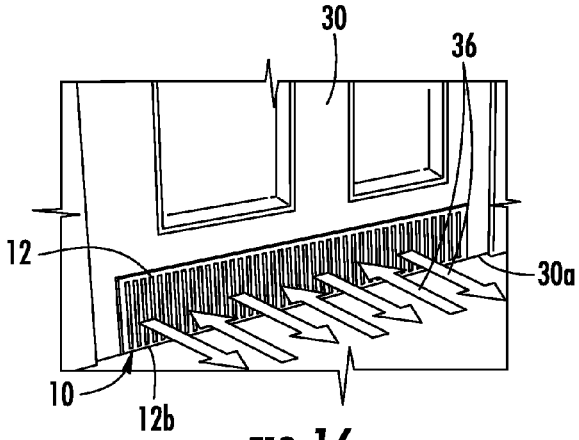
FIG. 16 is a perspective view of the door insert fully installed in a notch in a door in the process of balancing air pressure in accordance with the present invention.

FIG. 16 illustrates use of a door 30 that is equipped with a fully installed door insert 10 of the present invention. With the door insert 10 installed, the lowermost edge 12*b* of the frame 12 preferably remains aligned and flush with the bottom edge 30*a* of the door 30 to provide not only an attractive appearance but to allow unaffected operation of the door 30. Arrows 36 represent the free flow of air through the door insert 10, in both directions, to achieve the desired balance of air pressure in the environment.

The combination of media 14 and slots 22 in frame 12 are porous enough to permit air to flow in and out of a room to thereby balance the air pressure within the building or, at a minimum, between the two spaces on opposing sides of the door. The inventive door insert 10 of the present invention also reduces the amount of sound and light that would otherwise pass through a jump duct or undercuts on doors. Overall performance and efficiency of a building's HVAC system is improved as a result of use of the door insert 10 of the present invention. The present invention is new, novel and unique because it reduces sound and light while still permitting air to flow back to a return vent that is on the opposite side of a closed door. This enables the intended airflow and circulation to be effectively carried out even if doors are closed.

It would be appreciated by those skilled in the art that various changes and modifications can be made to the illustrated embodiments without departing from the spirit of the present invention. All such modifications and changes are intended to be covered by the appended claims.

What is claimed is:

1. A door panel and door insert for equalizing air pressure in a closed environment, comprising:

a door panel having a front face and a bottom edge; the bottom edge of the door panel defining a notch emanating inwardly therefrom; portions of the edge on opposing sides of the notch respectively defining a left tab receiving surface and a right tab receiving surface; the left tab receiving surface and the right tab receiving surface being perpendicular the front face of the door panel;

a frame having a bottom wall, a front wall, a back wall, a first side wall and a second side wall; the front wall and the back wall being in spaced apart and substantially parallel relationship to each other;

the first side wall and the second side wall interconnecting the front wall to the back wall; the first side wall and the second side wall being in spaced apart and substantially parallel relationship to each other; the front wall, back wall, first side wall and second side wall defining a slot; the bottom wall being connected to the front wall, back wall and first and second side walls to define a floor; the bottom wall having a left side and a right side;

a fixed left tab connected to and emanating laterally outward from the left side of the bottom wall and being in the same plane therewith;

a fixed right tab connected to and emanating laterally outward from the right side of the bottom wall and being in the same plane therewith;

the frame, fixed left tab and fixed right tab being configured and arranged as a single unitary member;

media having a plurality of apertures therethrough; the media residing in the slot and supported by the bottom wall of the frame;

the frame, with the media installed therein, being configured and arranged to reside within the notch;

the frame and media therein being secured in the notch by the fixed left tab being secured to the left tab receiving surface of the door panel and the fixed right tab being secured to the right tab receiving surface of the door panel; and whereby air is permitted to flow through the door insert to equalize the air pressure within an environment divided by the door panel.

2. The door panel and door insert of claim 1, wherein left fixed tab and fixed right tab are respectively positioned on opposing sides of the frame.

3. The door panel and door insert of claim 1, wherein the fixed left tab is secured to the left tab receiving surface by a fastener routed through an aperture in the fixed left tab and into the left tab receiving surface and wherein the fixed right tab is secured to the right tab receiving surface by a fastener routed through an aperture in the fixed right tab and into the right tab receiving surface.

4. The door panel and door insert of claim 1, wherein the frame is made of a material selected from the group consisting of plastic and metal.

5. The door and door insert of claim 1, wherein the media is made of a material selected from the group consisting of paper, plastic and metal.

6. The door panel and door insert of claim 1, wherein the media has a honeycomb configuration.

7. A door panel and door insert for equalizing air pressure in a closed environment, comprising:

a door panel having a bottom edge defining a notch emanating inwardly therefrom and tab receiving surfaces on opposing sides thereof;

a frame including a bottom wall and defining a slot;

media having a plurality of apertures therethrough; the media residing in the slot and supported by the bottom wall;

the frame, with media installed therein, being configured and arranged to reside within the notch; the frame being securable to the door panel;

a pair of fixed tabs respectively laterally emanating outwardly from opposing sides of the bottom wall of the frame to secure the frame to the door panel; the pair of fixed tabs being respectively secured to the tab receiving surfaces;

the frame and pair of fixed tabs being configured and arranged as a single unitary member;

whereby air is permitted to flow through the door insert to equalize the air pressure within an environment divided by the door panel.

8. The door panel and door insert of claim 7, wherein the frame is made of a material selected from the group consisting of plastic and metal.

9. The door panel and door insert of claim 7, wherein the media is made of a material selected from the group consisting of paper, plastic and metal.

10. The door panel and door insert of claim 7, wherein the media has a honeycomb configuration.

* * * * *